United States Patent [19]

Kessler

[11] 4,074,874

[45] Feb. 21, 1978

[54] LOCK PLATE FOR AN ARM OF A PILE FABRIC REEL FRAME

[75] Inventor: Theodore P. Kessler, Rancocas, N.J.

[73] Assignee: Timron, Inc., Moorestown, N.J.

[21] Appl. No.: 649,335

[22] Filed: Jan. 15, 1976

[51] Int. Cl.[2] ..... B65D 85/67; B65H 75/02

[52] U.S. Cl. ..... 242/77.1; 24/87 R; 24/205.18; 206/389; 211/4; 242/62

[58] Field of Search ..... 242/77.1, 62; 206/389, 206/408; 211/4, 6, 8, 16, 45–48, 125, 54, 57, 59; 24/87 R, 158, 205.18, 205.17

[56] References Cited

U.S. PATENT DOCUMENTS

| | | | |
|---|---|---|---|
| 1,047,582 | 12/1912 | Sokolow | 24/205.18 |
| 1,191,910 | 7/1916 | Pollock | 24/205.18 |
| 1,404,439 | 1/1922 | Horsfall | 211/45 |
| 2,048,805 | 7/1936 | McAuley | 24/205.17 |
| 2,944,752 | 7/1960 | Schwartz | 242/77.1 X |
| 3,944,157 | 3/1976 | Kessler | 242/77.1 |
| 3,952,964 | 4/1976 | Arden | 242/77.1 |

*Primary Examiner*—Harvey C. Hornsby
*Assistant Examiner*—John M. Jillions

[57] ABSTRACT

The hook strips of the end frames are provided with slidable locking plates which retain an impaled fabric on the hooks of the hook strips. Each locking plate is movable from a position which permits impaling of the fabric on the hook strips to a position closer to the hooks of the hook strips in order to retain the impaled fabric in place. Each locking plate has projections with sharp points which pass through the fabric to enhance securement.

16 Claims, 9 Drawing Figures

LOCK PLATE FOR AN ARM OF A PILE FABRIC REEL FRAME

This invention relates to an end frame for a pile fabric reel and particularly to an arm for an end frame for a pile fabric reel. Still more particularly this invention relates to a means for holding impaled fabric on a hook strip of a reel frame.

Heretofore, various types of reels have been known for reeling up pile fabric goods, such as velvet and plush, for shipping and storage purposes. Generally, these reels have been composed of two end frames which are mounted on and held in spaced apart relation by a spacer bar with each end frame containing a plurality of radiating hook containing sections or hook strips on which fabric edges or selveges can be impaled. Once fabric has been wound on, these reels are encased by a wrapper or within a separate container or carton for shipping purposes.

As is known, the fabric impaled on the reels is generally impaled on each hook in a multi-layered fashion. For example, two, three or four layers of fabric are impaled on each hook. However, it has been found that in some cases during shipment or storage, one or more layers may slip from the ends of the hooks. As a result, during subsequent handling, these unsecured edges may move relative to the remaining layers of fabric causing damage to the pile of the fabric. In some instances, whole sections of the reeled fabric may fall off the hooks with a result that the pile of the fabric in that section becomes crushed or otherwise damaged.

Accordingly, it is an object of this invention to provide an arm for a pile fabric reel end frame which precludes accidental removal of an impaled pile fabric.

It is another object of the invention to provide a simple means of holding selvege edges of pile fabric goods on a reel frame.

It is another object of the invention to provide an economical means of holding pile fabrics on reel frames.

Briefly, the invention provides an end frame for a pile fabric reel which comprises a plurality of hook containing sections or hook strips disposed in a radiating manner for impaling a pile fabric thereon and a plate which is movably mounted on at least one of the hook containing sections to retain an impaled fabric thereon. The plate which acts as a lock plate includes a means for holding impaled fabric on the hooks of the hook-containing section or strip. This holding means may be in the form of a plurality of projections which are moved between a first position spaced from the respective hooks of a hook-containing section to permit impaling of a fabric and a second position closer to the hooks to retain an impaled fabric.

A suitable means is provided for securing each plate to a hook-containing section, for example, slidably for movement between the first and second positions. In addition, a suitable means is provided for locking the plate to a hook-containing section or strip when the projections are in the second position.

The projections on the plate may also have points directed opposite to the direction of the hooks so as to impale the selvege edges of a fabric from the opposite side. This enhances securement of the fabric to the reel arm.

The hook-containing sections or hook strips may have a plurality of protrusions disposed in an alternating manner with the hooks. These protrusions can be arranged in overlapping fashion to the projections on the plate when the projections are in the first position spaced from the hooks. This provides a certain amount of protection against the sharp points that may be on the projections. In addition, the protrusions may also act as spacers for the layers of fabric being impaled on the hooks.

These and other objects and advantages of the invention will become more apparent from the following detailed description and appended claims taken in conjunction with the accompanying drawings in which:

Figure 1:
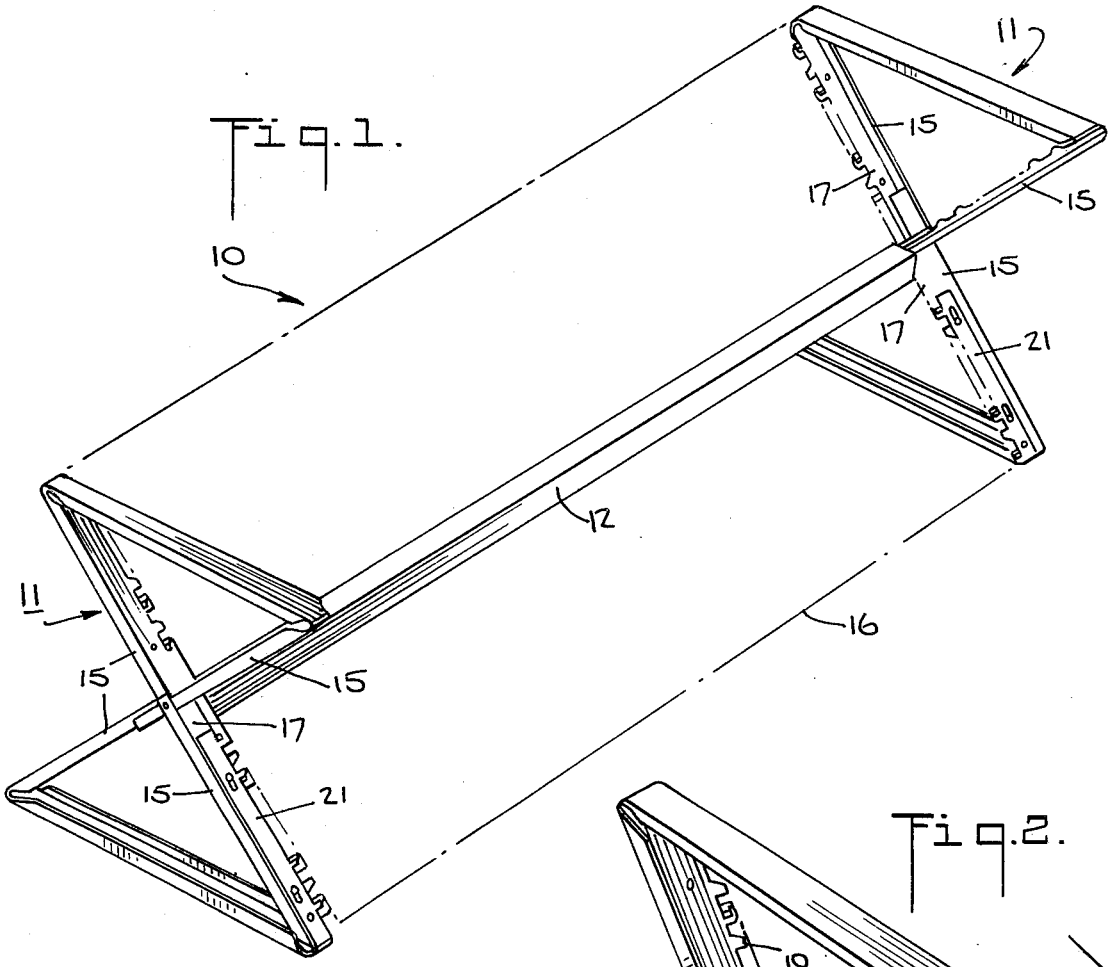
FIG. 1 illustrates a perspective view of a reel employing fabric holding arms in accordance with the invention.
Figure 2:
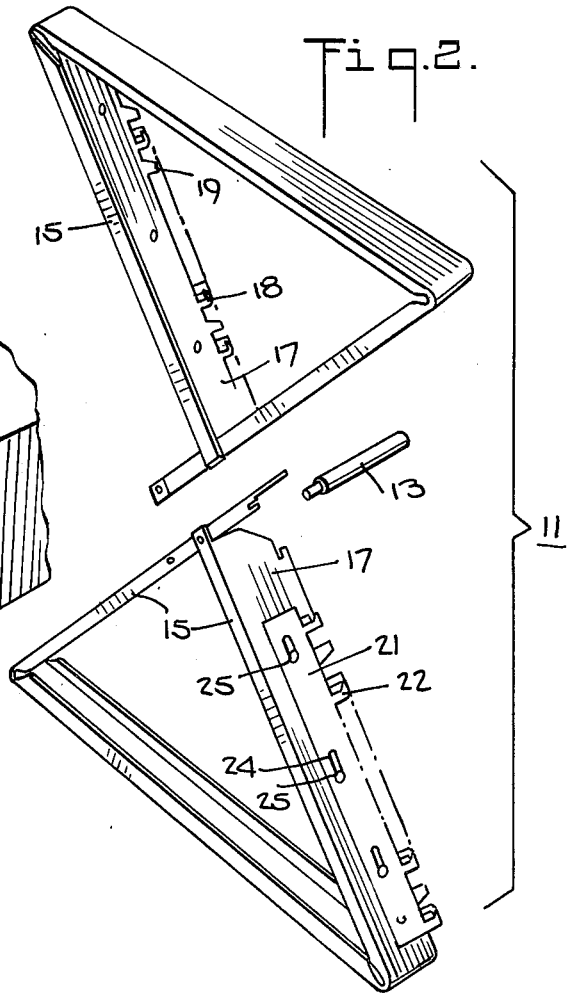
FIG. 2 illustrates an exploded view of an end frame in accordance with the invention.
Figure 3:
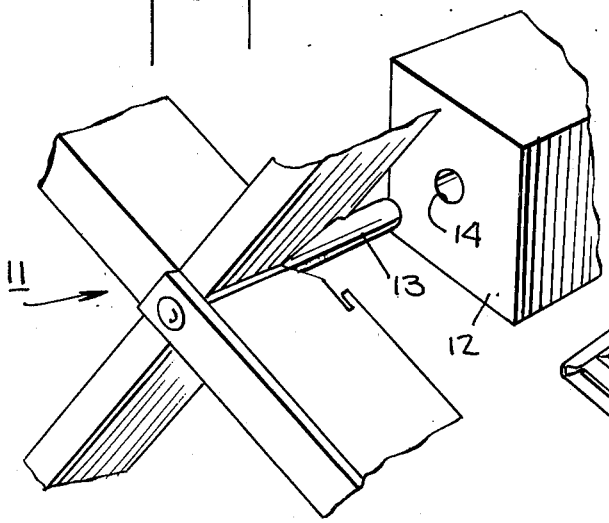
FIG. 3 illustrates a perspective view of a manner of mounting an end frame to a spacer bar.

Referring to FIG. 1, a pile fabric reel 10 includes a pair of end frames 11 and a spacer bar 12 mounted between the end frames 11. Each end frame 11 is constructed in similar manner to the end frames described in U.S. Pat. No. 3,593,847. To this end, as shown in FIG. 2, each end frame 11 is made of a pair of reel arm units which are held together by a single round pin 13 positioned at the center of the end frame 11 on the axis of the reel. The pin 13, as shown in FIG. 3, is inserted into a suitable aperture 14 in the spacer bar. As shown, each end frame 11 includes a plurality of arms 15 for example four, disposed in a radiating manner relative to the axis of the reel 10 for impaling a pile fabric 16 thereon.

Figure 4:
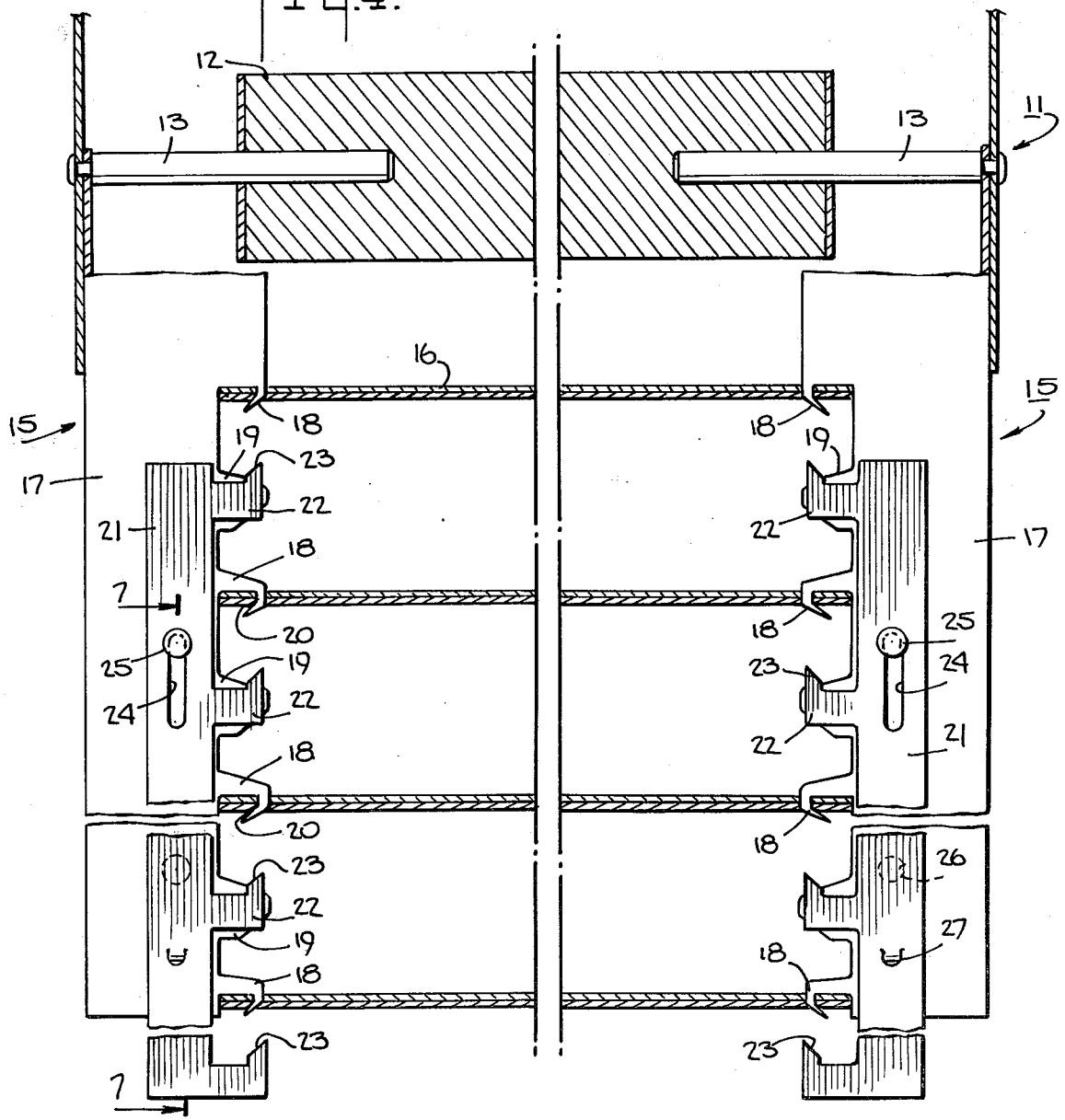
FIG. 4 illustrates a side view of the reel of FIG. 1 with pile fabric impaled on the hooks of the hook strips.
Figures 6, 7, 8, 9:
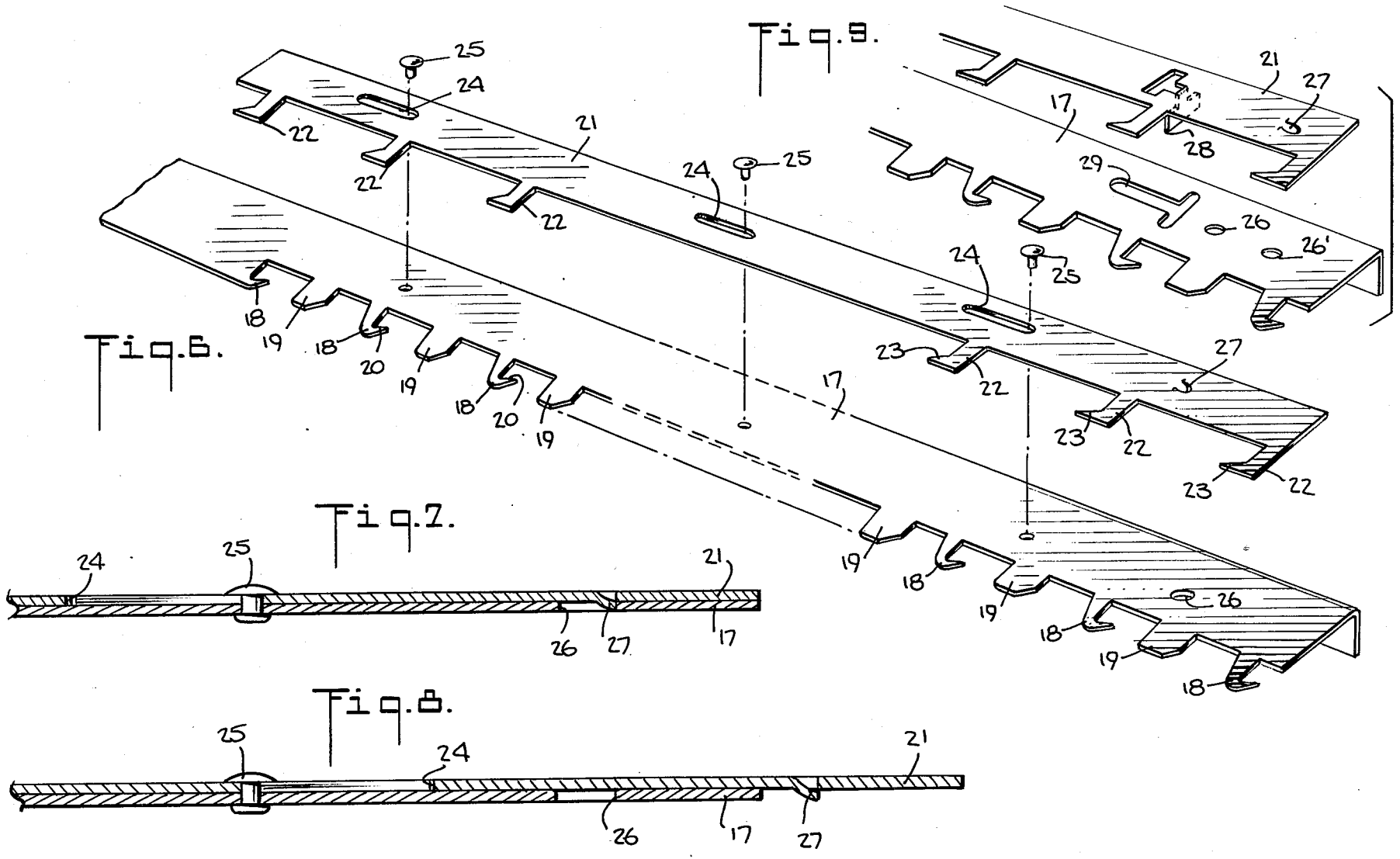
FIG. 6 illustrates an exploded view of an arm made in accordance with the invention.
FIG. 7 illustrates a view taken on line 7—7 of FIG. 4.
FIG. 8 illustrates a view taken on line 8—8 of FIG. 5.
FIG. 9 illustrates a perspective fragmentary view of a modified lock plate and hook strip according to the invention.

Referring to FIGS. 2, 4 and 6, each arm 15 includes a hook-containing section or hook strip 17 having a plurality of spaced apart hooks 18 and a plurality of protrusions 19 disposed in alternating manner with the hooks 18. Each hook 18 is of J-shape and, as particularly shown in FIG. 4, the pointed end of each hook 18 is in-turned and has a flat interior side 20. In addition, each arm 15 includes a plate 21 which is movably mounted on a hook strip 17. This plate 21 which acts as a lock plate is of flat shape to slide along the hook strip 17 and is made, for example of sheet metal. The plate 21 includes a plurality of projections 22 which are disposed for movement between a first position disposed in overlapping relation with the protrusions 19 and a second position closer to the hooks 18 to retain an impaled fabric therebetween. As more particularly shown in FIG. 4, each projection 22 has a point 23 directed in an opposite direction to a hook 18.

Referring to FIG. 4, when the projections 22 of a lock plate 21 are in the first position spaced away from the hooks 18 of a hook strip 17, there is sufficient space to impale the selvege edges of the fabric 16 on the hooks 18 in multi-layer fashion. In this position, the projections 22 are disposed in overlapping relation with the protrusions 19 on the hook strip 17.

Figure 5:
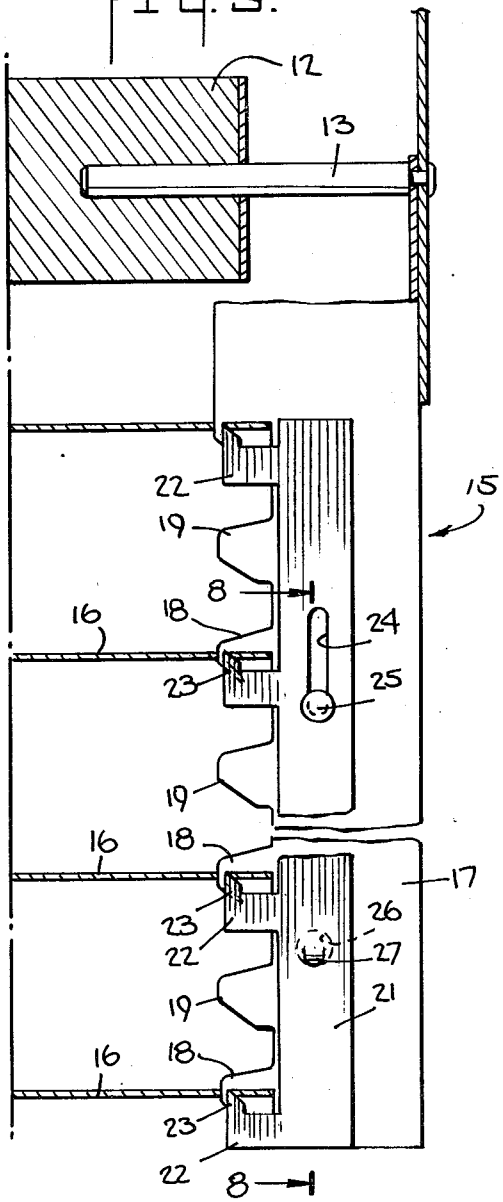
FIG. 5 illustrates a view similar to FIG. 4 with the lock plate in position to hold the impaled fabric on the hook strips.

Referring to FIG. 5, when in the second position, the projections 22 of a lock plate 21 are in overlapping relation with the hooks 18 of a hook strip 17. In this position, the points 23 of the projections 22 pass through the selvege of a fabric 16 impaled on the hooks 18 so as to enhance securement of the fabric on the arms 15.

As shown in FIG. 5, when the lock plate 21 has been slid into the locking position, the points 23 of the projections 22 and the hooks 18 overlap each other. This provides a secure means of maintaining a selvege edge in place on the reel 10. Any slippage of the selvege from one hook 18 is prevented by a projection 22 and any slippage from the point 23 of a projection 22 is prevented by a hook 18. In addition, the in-turned part of the hooks 18 may be adapted to the shape of the points 23 on the plate 21 or vice versa.

The protrusions 19 on the hook strip 17 serve a dual function. First, these protrusions 19 act as spacers for the various layers of fabric 16 reeled upon a reel 10. Second, the protrusions 22 overlap the projections 22 of the lock plate 21 to limit the danger to a user catching clothing or their person on the points 23 of the projections 22.

Referring to FIGS. 4 to 6, a means is provided to removably mount each lock plate 21 on a hook-containing section 17. To this end, the means includes a plurality of longitudinally elongated slots 24, for example three, in the lock plate 21 and a corresponding number of rivets 25 secured to the hook strip 17. Each rivet 25 passes through an elongated slot 24 and has a head to the outside of the slot 24 so that the lock plate 21 is secured to the hook strip 17. Each of the elongated slots 24 may also be provided with a slightly enlarged opening at the end corresponding to the locking position of the lock plate 21 to accommodate a rivet 25. As indicated, the longitudinal length of each slot 24 is sized to permit movement of the lock plate 21 over an extent required to permit each projection 22 to move between the position in which the projections 22 do not interfere with impaling of the fabric 16 on the hooks 18 and the position in which the projections 22 retain the fabric 16 on the hooks 18.

Referring to FIGS. 7 and 8, a suitable means is provided to lock each plate 21 to a hook strip 17 when the projections 22 are in the holding position. As indicated, this means is in the form of a single cut-out 26 in the hook strip 17 and a single tab 27 on the hook plate 21 which is sized for selective reception in the cut-out 26. Alternatively, the cut-out may be in the lock plate and the tab in the hook strip. Any other suitable locking means may also be used. The tab 22 is formed at an angle with respect to the lock plate 21 so as to project through the cut-out 26 when in the locked position. Further, the angularity of the tab 22 prevents accidental sliding of the lock plate 21 relative to the hook strip 17. Further, in order to move the lock plate 21 from the locking position (FIG. 7), it is necessary to deflect the end of the lock plate 21 slightly to bring the tab 27 out of the plane of the cut-out 26. Thereafter, the lock plate 21 can be easily slid into the open position relative to the hook strip 17 (FIG. 8).

In order to fabricate an arm 15, a hook strip 17 and a plate 21 are made and then plced together for passage of a set of rivets 25 through the slots 24. During this time, the end of each rivet which passes through the plate 21 and hook strip 17 is upset by a suitable swaging tool (not shown) to secure the plate 21 and hook strip 17 together in slidable relation.

Referring to FIG. 9, wherein like reference characters indicate like parts as above, the means for removably mounting each lock plate 21 on a hook containing section 17 may alternatively be in the form of a tongue and groove arrangement. To this end, the lock plate 21 has a tab 28 of T-shape cut out of the main body of the lock plate 21 and bent so as to be disposed substantially perpendicularly of the lock plate 21. In addition, a T-shaped slot 29 is provided in each hook containing section 17 to cooperate with a tab 28. As shown, the T-slot is elongated along the axis of the hook containing section and has a transverse portion at one end to receive the tab 28. The use of the T-shaped tab 28 and slot 29 arrangement allows a customer to assembly a slidable lock plate onto a regular frame provided with T-shaped slots.

Referring to FIG. 9, the hook strips 17 may be provided with a pair of cut-outs 26, 26'. In this case, one cut-out 26' cooperates with the tab 28 so as to hold the lock plate 21 in the open position while cloth is being wound on the hook strips 17. The other cut-out 26 cooperates with the tab 27 so as to hold the lock plate 21 in closed position after the cloth has been wound onto the hook strips 17. For this purpose, the lock plates are dimensioned so as to permit entry of the tab 27 into the respective cut-outs 26, 26' for the respective positions relative to the hook strips 17.

The invention thus provides a hook strip with a simple means of holding impaled fabric on the hooks of the hook strips.

The invention further provides an arm for an end frame of a pile fabric reel which can be made of any suitable material in any suitable manner. For example, the arms may be made individually and may be secured to a common holder for disposition in a radiating manner. The arms may be made, for example, as shown in U.S. Pat. No. 3,593,847 or as described in U.S. Pat. No. 3,944,157.

Further, the invention provides a means of holding impaled fabric on the hook strips of a reel which does not add any significant amount of weight to the overall weight of the reel. To this end, each lock plate is made of relatively thin gauge material, for example being of one-third to one-fourth the thickness of a hook strip. The thinness of the lock plate allows resilient flexing of the end of the plate when it is necessary to "open" the arm, that is, when the tab 27 is to be moved out of the cut-out 26. The resiliency allows repeated uses. Further, the rivets and slots on each hook strip and plate provide a reliable way of positioning the plate on the hook strip and of maintaining rigidity in the plate.

What is claimed is:

1. An end frame for a pile fabric reel comprising:

a plurality of hook-containing sections disposed in a radiating manner for impaling of a pile fabric thereon; and a lock plate movably mounted on each said hook-containing section to retain an impaled pile fabric thereon, each said lock plate including a plurality of spaced projections, at least some of said projections being movable between a first position spaced from a respective one of said hooks of said one hook-containing section and a second position closer to said one hook to retain impaled fabric therebetween.

2. An end frame as set forth in claim 1, wherein said projections in said second position each have a point disposed in overlapping relation to a respective hook.

3. An end frame for a pile fabric reel comprising:

a plurality of hook-containing sections disposed in a radiating manner for impaling of a pile fabric selvege thereon, each said section having a plurality of spaced hooks;

a lock plate movably mounted on each hook-containing section, each lock plate including a plurality of projections for movement between a first position spaced from respective hooks of each hook-containing section and a second position closer to said hooks to retain an impaled fabric therebetween; and means for locking each said plate to a respective hook-containing section with said projections in said second position.

4. An end frame as set forth in claim 3 wherein said means includes a cut-out in one of said sections and said plates and a tab in the other of said sections and said plates for selective reception in said cut-out.

5. An end frame as set forth in claim 3 which further comprises means for slidably securing each said plate to a respective section.

6. An end frame as set forth in claim 3 wherein said latter means includes a T-shaped tab on each said plate and a T-shaped slot on each said hook-containing section receiving said T-shaped tab therein.

7. An arm for a pile fabric reel comprising:

a hook-containing section having a plurality of spaced hooks and a plurality of protrusions disposed in alternating manner with said hooks, and a lock plate movably mounted on said section and including a plurality of projections for movement between a first position disposed in overlapping relation with said protrusions and a second position closer to said hooks to retain an impaled fabric therebetween.

8. An arm as set forth in claim 7 wherein said projections overlap said hooks in said second position.

9. An arm as set forth in claim 8 wherein each projection has a point directed in a direction towards a respective hook.

10. An arm as set forth in claim 7 which further comprises means for slidably mounting said plate on said hook containing section for movement between a first position in which said means for holding is spaced from said hooks to permit impaling of a fabric and a second position in which said means for holding is closer to said hooks to preclude removal of an impaled fabric from said hooks.

11. An arm as set forth in claim 10 which further comprises means for locking said plate to said section in said second position.

12. An arm as set forth in claim 7 which further comprises means for locking said plate to said section with said projections in said second position.

13. An arm as set forth in claim 8 wherein said means includes a cut-out in one of said section and plate and a tab in the other of said section and plate for selective reception in said cut-out.

14. An arm as set forth in claim 8 wherein each hook is of generally J-shape.

15. An arm as set forth in claim 7 which further comprises means for slidably securing said plate to said section for movement between said first and second positions.

16. An arm as set forth in claim 15 wherein said latter means includes a T-shaped tab on said plate and a T-shaped slot on said hook-containing section receiving said T-shaped tab therein.

* * * * *

UNITED STATES PATENT OFFICE

CERTIFICATE OF CORRECTION

Patent No. 4,074,874 Dated February 21, 1978

Inventor(s) Theodore P. Kessler

It is certified that error appears in the above-identified patent and that said Letters Patent are hereby corrected as shown below:

Column 3, line 66, "plced" should read -- placed --.

Column 5, line 26, "3" should read -- 5 --.

Signed and Sealed this

*Eighth* Day of *August 1978*

[SEAL]

*Attest:*

RUTH C. MASON
*Attesting Officer*

DONALD W. BANNER
*Commissioner of Patents and Trademarks*